US005333865A

United States Patent [19]

Holmes

[11] Patent Number: 5,333,865

[45] Date of Patent: Aug. 2, 1994

[54] FOOTBALL GAME

[76] Inventor: Gregory A. Holmes, 720 W. Becher St., Milwaukee, Wis. 53215

[21] Appl. No.: 144,632

[22] Filed: Oct. 28, 1993

[51] Int. Cl.[5] ..... A63F 7/06

[52] U.S. Cl. ..... 273/94; 273/400; 273/247

[58] Field of Search ..... 273/94, 400, 407, 55 R, 273/55 A, 371, 255, 411, 412, 244, 245, 246, 247, 259

[56] References Cited

U.S. PATENT DOCUMENTS

| | | | |
|---|---|---|---|
| 1,603,717 | 10/1926 | Rubino | 273/94 R |
| 1,693,277 | 11/1928 | Hustwick | 273/94 R |
| 1,954,838 | 4/1934 | Woolsey | 273/94 R |
| 2,455,185 | 11/1948 | May | 273/400 X |
| 4,326,722 | 4/1982 | Dickens | 273/400 |
| 4,762,323 | 8/1988 | Blagg | 273/94 X |
| 5,037,095 | 8/1991 | Nedwick | 273/400 X |
| 5,186,461 | 2/1993 | Tucker | 273/94 R |

*Primary Examiner*—Vincent Millin
*Assistant Examiner*—Sebastiano Passaniti
*Attorney, Agent, or Firm*—Ryan, Kees & Hohenfeldt

[57] ABSTRACT

An amusement apparatus simulating the game of football is provided. The apparatus includes a simulated playing field, a deck of cards bearing instructions for offensive football plays of designated types, a toy football made of soft material such as foam rubber, and a receiving figure. The receiving figure is formed of a flat vertical member, a base to which the flat upright member is attached and a receiving receptacle attached to the forward side of the vertical member. The receiving receptacle is of a size sufficiently large to receive the football and has enclosed side bottom and forward sidewalls and an open top.

3 Claims, 2 Drawing Sheets

FOOTBALL GAME

FIELD OF THE INVENTION

The present invention relates to a game that simulates the game of football. More specifically, the invention relates to such a game that utilizes a foam football, a receiving figure and a deck of cards to indicate the type of play to be made.

BACKGROUND OF THE INVENTION

Simulated football games have heretofore been devised or suggested. For example, Siegel U.S. Pat. No. 2,873,971 issued Feb. 17, 1959, illustrates one form of such a game wherein playing cards, spinners and a small simulated playing field were employed. In accordance with another suggestion, small movable targets were located on a board that were enabled to receive a projectile by use of hook and loop fasteners of the Velcro® type. See U.S. Pat. No. 4,150,823 issued Jun. 10, 1977. While these prior art suggestions have met with limited success, it has remained desirable to develop simulated football games for indoor use that more closely simulate the actual game of football.

SUMMARY OF THE INVENTION

It is a principal object of the present invention to provide a new and improved game that provides an exciting simulation of a real football game for enjoyment by two or more players. In accordance with an important aspect of the invention, a game of football is simulated by the use of a small foam football that can be used in conjunction with a receiving figure. The invention further provides a simulated football field and may include a goal post and a kicking tee. A deck of playing cards bearing instructions regarding the type of play to be made is provided in order to allow the players to make plays in turn.

In accordance with a further aspect of the invention, the game of football is simulated in a manner such that elements of skill and chance are involved in the play of the game. The apparatus of the invention includes a simulated playing field, a deck of cards bearing instructions for offensive football plays of designated types, a toy football made of soft material such as foam rubber, and a receiving figure. The receiving figure is formed of a flat vertical member, a base to which the flat upright member is attached and a receiving receptacle attached to the forward side of the vertical member. The receiving receptacle is of a size sufficiently large to receive the football and has enclosed side bottom and forward sidewalls and an open top.

BRIEF DESCRIPTION OF THE DRAWINGS

These, and other objects and advantages of the invention, will become further apparent from the accompanying detailed description and drawings wherein.

DETAILED DESCRIPTION OF THE DRAWINGS

Figures 1, 2:
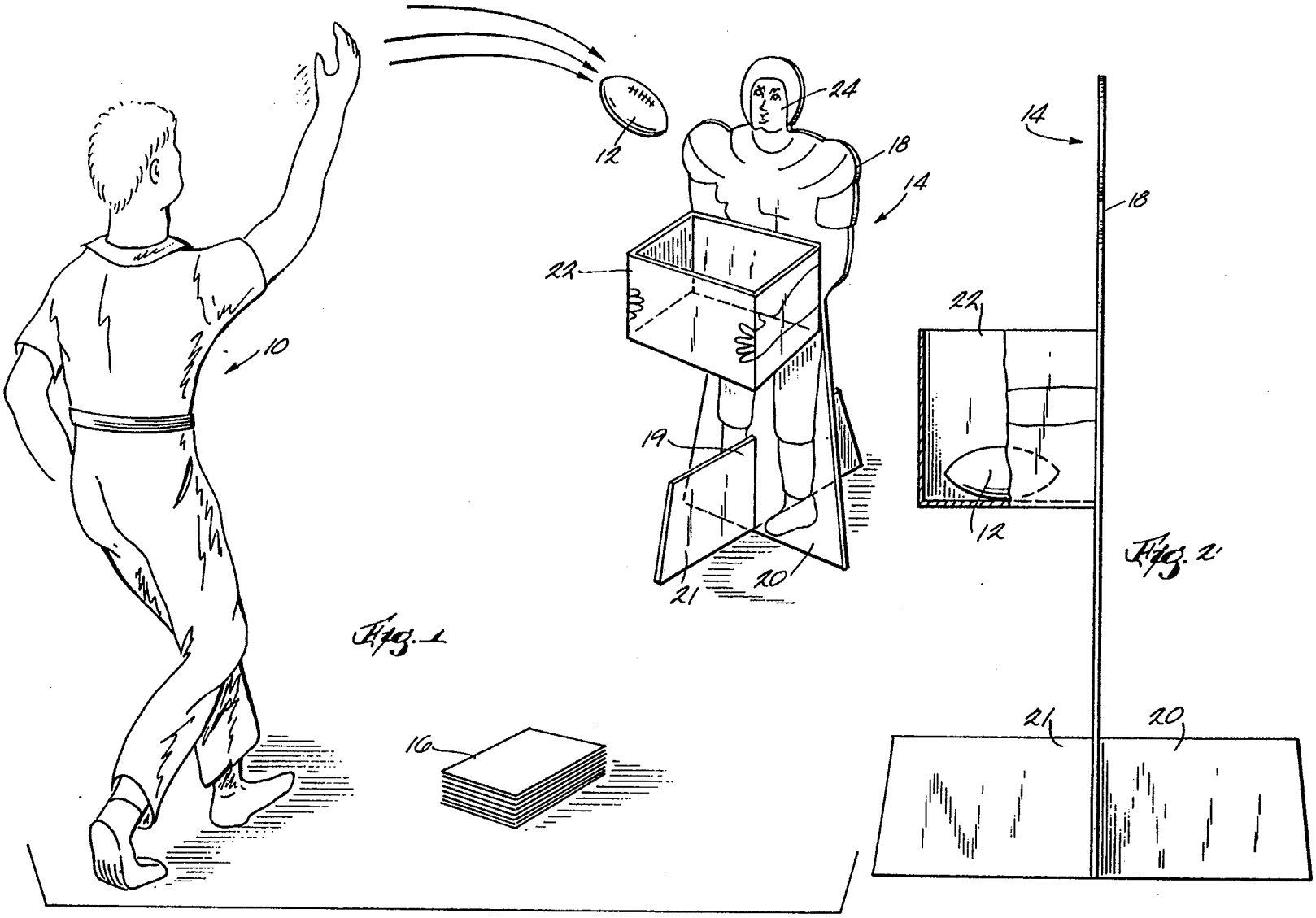
FIG. 1 is a perspective view illustrating a player throwing a forward pass in accordance with the invention.
FIG. 2 is a side elevational view of a receiving figure of this invention with parts broken away and in cross-section for purposes of clarity.
Figure 3:
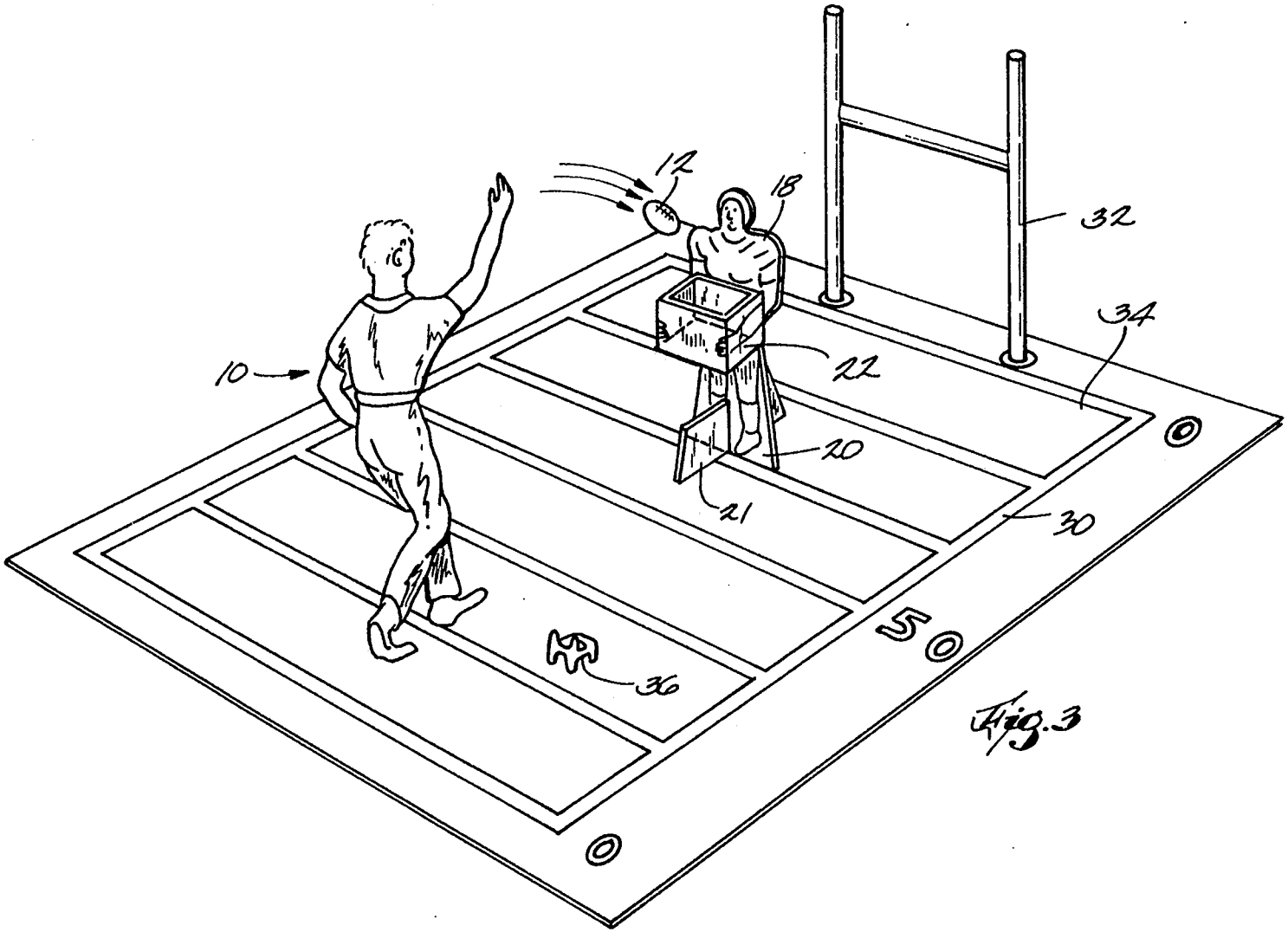
FIG. 3 is a perspective view of the invention including a simulated field, kicking tee and goal post.

As seen in FIG. 1, a player 10 is engaged in tossing a foam football 12 toward a receiving FIG. 14. A deck of cards 16 is provided with instructions for the player. The card drawn by player 10 indicates the type of play to be made or attempted.

As seen, receiving FIG. 14 is formed from a flat upright vertical portion 18 supported by a base portion 20. While base portion 20 is illustrated as being formed of a single cross-member 21 that fits in a slot 19 in the lower portion of flat vertical member 18, it will readily be apparent that other forms of bases may be employed. For example, the base portion 20 could be formed from a flat disk or other shaped block of material that is provided with a slot on its upper surface to receive vertical member 18. If desired, other fastening means such as tacks, staples or screws can be utilized to attach vertical member 18 to a base.

Vertical member 18 can be formed from any suitable rigid material such as sheet plastic, cardboard, plywood or the like. A receptacle 22 is secured to the front of the vertical portion 18. If the receiving FIG. 14 is formed from cardboard, for example, receptacle 22 can be formed by appropriate folding and interlocking of flaps of the cardboard. In the case of other materials, it may be desirable to attach receptacle 22 to the vertical member by means of fasteners. In order to simulate a football player who is a pass receiver, inscriptions 24 are provided on one or both sides of the figure.

In addition to the receiving FIG. 14, a goal post can be provided either in the form of an area marked on a wall or by means of an actual uprights and cross bar member 32. A simulated football field 34 for indoor use can be provided either by application directly to a floor of elongated linear material such as masking tape 30 at appropriate intervals to indicate yard markers, out-of-bounds markers and goal lines. In accordance with an alternative embodiment, such markings can be provided on a sheet of material such as light-weight carpeting which can be laid out flat for use and subsequently rolled up again for storage.

For play of the game, the cards of deck 16 can have instructions such as "no play" in which event the player loses a turn. If a "short play" card is drawn, the receiver figure is placed relatively close to player 10. If a "long play" card is drawn, the receiver figure is placed a longer distance away from player 10.

Rules are developed for scoring of the game paralleling those of the game of football. For example, it can be provided that if a player successfully completes a pass to a receiver at the far end of the field he receives six points for a touchdown and is given an opportunity to kick for an extra point. If desired, cards can be included for kicking plays whereby the player can attempt a field goal by placing the ball in a tee 36 and kicking it. Further cards can also indicate turnovers, in which event, the other player would proceed to play.

It will, thus, be appreciated that the aspects of football relating to passing of the ball or kicking of the ball are simulated by the game. Since an element of skill is involved, the interest of the players is maintained. This skill element enables the players to improve their performance by repeated play or practice of the game.

While preferred embodiments of the invention have been described herein, it will readily be apparent that modifications can be made within the scope of the appended claims.

What is claimed is:

1. Amusement apparatus simulating the game of football comprising:

a simulated playing field;

a deck of cards bearing instructions for offensive football plays of designated types;

a toy football made of soft material; and a receiving figure comprising a flat vertical member, a base to which said flat upright member is attached, a receiving receptacle attached to a forward side of said vertical member, said receiving receptacle having enclosed side, bottom and forward sidewalls and an open top, said receptacle being of a size sufficiently large to receive said football.

2. Apparatus in accordance with claim 1 wherein said football comprises a foam material in the shape of a football.

3. Apparatus in accordance with claim 1 wherein said apparatus further comprises a simulated field goal and a kicking tee.

* * * * *